United States Patent [19]

Zoor

[11] 4,134,603

[45] Jan. 16, 1979

[54] SAFETY SKI BINDING

[75] Inventor: Reinhold Zoor, Dachau, Fed. Rep. of Germany

[73] Assignee: Heinrich Wunder KG., Fed. Rep. of Germany

[21] Appl. No.: 797,238

[22] Filed: May 16, 1977

[30] Foreign Application Priority Data

May 15, 1976 [DE] Fed. Rep. of Germany ..... 2621758
Dec. 27, 1976 [DE] Fed. Rep. of Germany ..... 2658992

[51] Int. Cl.[2] ..... A63C 9/08
[52] U.S. Cl. ..... 280/614; 280/629
[58] Field of Search ..... 280/613–618, 280/626, 629, 636

[56] References Cited

U.S. PATENT DOCUMENTS

| | | | |
|---|---|---|---|
| 3,079,163 | 2/1963 | Beausacq | 280/616 |
| 3,399,902 | 9/1968 | Adam | 280/629 |
| 3,406,981 | 10/1968 | Scheib | 280/629 |
| 3,927,895 | 12/1975 | Spier | 280/636 |
| 3,936,064 | 2/1976 | D'Alessio | 280/629 X |

*Primary Examiner*—Joseph F. Peters, Jr.
*Assistant Examiner*—Gene A. Church
*Attorney, Agent, or Firm*—Peter K. Kontler

[57] ABSTRACT

A ski binding wherein the housing of a safety device is secured directly to the upper side of the ski or to a cross country frame whose front end portion is pivoted to the ski. The housing has and/or contains friction reducing balls, rollers, liners and/or edge portions which guide a carriage for the front or rear hold-down device. The carriage is movable relative to the housing in a horizontal plane at right angles to the skiing direction and is normally held in a neutral position, in which the front part of the sole or the heel of a ski boot rests on its top surface, by the lobe of an eccentric which is rotatable in the housing and is normally held against rotation from the angular position corresponding to neutral position of the carriage by a set of prestressed helical springs reacting against the housing and bearing against a retainer having a flat abutting a flat of the eccentric. When the carriage is subjected to the action of a force whose magnitude exceeds a preselected value, the lobe of the eccentric is expelled from a socket of the carriage and the latter moves transversely of the skiing direction to a position of complete disengagement from the housing.

30 Claims, 13 Drawing Figures

SAFETY SKI BINDING

BACKGROUND OF THE INVENTION

The invention relates to ski bindings in general, and more particularly to improvements in safety ski bindings which automatically release the boot in response to the application of forces whose magnitude warrants separation of the boot from the ski in order to prevent or at least reduce the likelihood of injury to the skier.

German Auslegeschrift No. 1,201,738 discloses a safety ski binding wherein a sheet metal plate is reciprocable in arcuate guides in directions substantially transversely of the skiing direction. That portion of the sole of a ski boot which is located immediately below the ball behind the toes of the skier's foot rests directly on the plate and the center of curvature of the arcuate path defined by the guides is located below the heel of the boot. The plate rests on and is slidable relative to a sheet metal base whose upper side has friction-reducing ribs engaging the underside of the plate. The tip of the boot is urged against a pivotable jaw of the binding by a cable, and the jaw has a hold-down device for the front portion of the boot. A reciprocable tongue is employed to separably couple the plate to the jaw; the jaw has a pin which extends into a slot of the tongue when the plate assumes its operative position. Each movement of the plate from its operative position must be preceded by a pivotal movement of the jaw from an operative position in which the hold-down device engages the boot. Such movement of the jaw results in withdrawal of the pin from the slot of the tongue and thus frees the plate for movement along the arcuate path. The plate has upwardly extending flanges which are engaged by the respective sides of the sole resting on the plate and insure that the plate shares lateral movements of the sole upon movement of the jaw from its operative position.

The patented binding exhibits a number of serious drawbacks. First of all, the boot is shifted relative to the hold-down device during disengagement of the plate from the base, i.e., the boot acts not unlike a component part of the binding which means that the facility with which the plate is disengaged from the base depends on the material and/or configuration of the boot. Secondly, the aforementioned ribs merely reduce friction between the plate and the base, i.e., friction between the plate and the arcuate guides is quite pronounced so that the magnitude of the force which must be applied in order to disengage the plate from the base cannot be selected with a satisfactory degree of reproducibility. As a rule, the front and rear edge portions of the plate are received in dovetailed guides whose resistance to sliding movement of the respective edge portions is rather high. Frictional engagement between the guides and the edge portions of the plate is even more pronounced if one of the hold-down devices (normally the rear hold-down device) embodies or is combined with springs which urge the boot against the other hold-down device, i.e., in or counter to the skiing direction. Still further, the patented binding is not suited for cross country skiing because, were such binding mounted on the front portion of a cross country frame whose front end is pivoted to the ski, the aforementioned jaw would prevent the placing of the tip of the sole of a ski boot in line with the pivot of the frame so that a cross country skier would be compelled to lift the rear portion of the ski off the ground in response to each lifting of the heel of the boot.

German Offenlegungsschrift No. 2,157,791 discloses a ski binding wherein the entire underside of the boot rests on a plate cooperating with a release mechanism which allows the plate and the boot to become disengaged from the ski in the event of an accident or whenever the boot and/or the plate is subjected to the action of large forces acting transversely of the skiing direction and in parallelism with the upper side of the ski. A drawback of such bindings is that their weight greatly exceeds the maximum acceptable or recommended weight, especially for cross country skiing. Also, if the plate is very rigid, it unduly increases the stiffness of the adjacent portion of the ski. On the other hand, a flexible plate is likely to undergo excessive deformation in response to flexing of the ski so that the plate will be incapable of adequately supporting or will become disengaged from the boot in situations and under circumstances when such disengagement is not only undesirable but also dangerous. Known proposals to avoid excessive stiffening of the ski or undersirable deformation of the plate contribute significantly to the initial cost and bulk of the just discussed binding.

OBJECTS AND SUMMARY OF THE INVENTION

An object of the invention is to provide a ski binding which embodies a novel and improved safety device which is automatically disengaged to thereby release the boot of a skier in response to the application of a force that is likely to cause injury to the skier if the boot remains connected to the ski.

Another object of the invention is to provide a safety ski binding which embodies the improved safety device and can be used with equal advantage for cross country as well as downhill skiing.

A further object of the invention is to provide a safety ski binding which may but need not be directly connected to the upper side of a ski, which is of simple and compact design, which can be readily manipulated by professional skiers as well as by amateurs or beginners, and which can properly engage and support ski boots or other types of footwear in a variety of sizes and/or shapes.

An additional object of the invention is to provide a ski binding whose safety device is constructed and assembled in such a way that frictional and/or other forces offer negligible resistance to disengagement of a ski boot from the ski when the boot and/or the boot-contacting part or parts of the safety device are subjected to the action of forces acting in a preselected direction and reaching a preselected magnitude which warrants immediate or rapid disengagement of the boot.

An ancillary object of the invention is to provide a safety ski binding which does not contribute to undesirable increase in stiffness or rigidity of adjacent portion of the ski, which can be mounted on skis of any desired size or shape, and which can be rapidly reassembled (without resorting to any tools) upon forcible disengagement of the boot from the ski.

Another object of the invention is to provide a safety ski binding which can release the boot in response to the application of forces acting upon the boot and/or upon selected parts of the safety device in a direction which is substantially normal to the skiing direction, either in a plane parallel to the upper side of the ski or at right angles to the upper side.

An ancillary object of the invention is to provide a relatively inexpensive safety ski binding which can be readily adjusted to enable the boot to offer any one of a wide range of resistances to disengagement from the ski.

The invention is embodied in a safety ski binding which comprises a hollow housing or an analogous support, a cross country frame, a plate, a set of screws or analogous means for securing the support to a ski, a carriage having a boot-supporting portion, guide means provided on and/or in the support and defining for the carriage a path extending substantially transversely of the skiing direction (such may be a preferably slightly arcuate path in a plane which is parallel to the upper side of the ski or a path which is normal to the upper side of the ski), means for releasably and yieldably connecting the carriage to the support so that the carriage is fully separable from the support by moving along the aforementioned path in response to the application of a predetermined force (e.g., in response to turning of the boot about its heel or about the tip of its sole, depending upon whether the carriage is located below the tip of the sole or below the heel), a hold-down device for the tip of the sole or the heel of a ski boot, and eyelets or other types of bearing members coupling the hold-down device to the carriage.

The connecting means includes cooperating first and second components which are respectively provided solely on the carriage and the support and normally maintain the carriage in an operative or neutral position above the upper side of the ski which carries the support. The guide means includes friction reducing elements forming part of or installed in the support; such elements may include transversely extending edge portions forming part of a cover plate of the support, spring-biased and/or fixedly mounted rollers in the support, liners in or on the support and/or groups or sets of antifriction ball or roller bearings in the support.

The novel features which are considered as characteristic of the invention are set forth in particular in the appended claims. The improved binding itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENT

Figure 2:
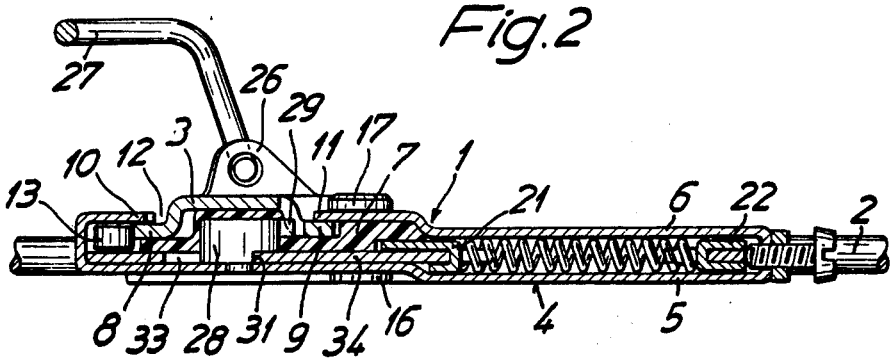
FIG. 2 is a longitudinal vertical sectional view as seen in the direction of arrows from the line II—II of FIG. 1.

FIGS. 1–4 and 12 show a safety ski binding which embodies one form of the invention. The binding is mounted on a cross country ski 41 and includes a frame 54 the front end portion of which has a rod-shaped traverse **54*a* constituting the pintle of a hinge whose leaf 55 is bolted or otherwise secured to the upper side of the ski 41 so that the entire frame 54 can pivot about a horizontal axis (of 54*a*) which is normal to the skiing direction (arrow 41*a*). Such pivoting of the frame 54 is desirable during cross country skiing. If the user of the ski is about to travel downhill, the traverse 54*b* at the rear end of the frame 54 is separably coupled to the adjacent portion of the ski 41 by a pivotable pawl 56** of known design.

The rear portion of the frame 54 is provided or connected with a plate-like heel support or bracket 43 flanked by or embodying two bearing plates 42 for the yoke 45 of a releasable hold-down device 44. The device 44 engages the ski boot at or above the heel and is provided with means for permitting its disengagement from the boot, either in the event of an accident or at the will of the user. Reference may be had to my commonly owned copending application Ser. No. 746,185 filed Nov. 26, 1976.

The safety device 1 which embodies one form of the present invention is mounted on the front portion of the frame 54 behind the traverse **54*a*. This device is disposed in the space between two rod-like lateral frame members 2 of the frame 54 and comprises basically a support or housing 4 secured to the frame 54, a carriage or slide 3 which is movable with reference to the housing 4 along an arcuate path whose center of curvature is located at or close to the heel support 43, means for releasably connecting the carriage 3 to the housing 4, and a yoke-like hold-down device 27 which is arriculately coupled to the carriage 3**.

Figure 4:
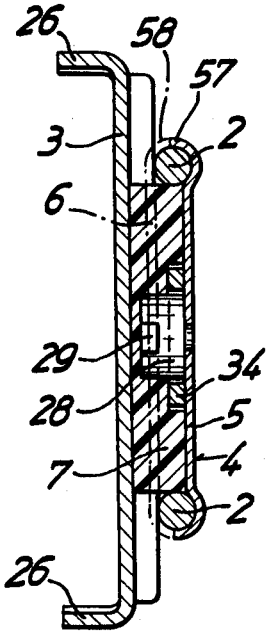
FIG. 4 is a transverse vertical sectional view as seen in the direction of arrows from the line IV—IV of FIG. 1.

The support or housing 4 comprises a base plate 5 and a spaced-apart top or cover plate 6. The distance between plates 5, 6 equals or approximates the diameters of the frame members 2. As shown in FIG. 4, the longitudinally extending marginal portions 57 of the base plate 5 form substantially semicylindrical troughs which surround the lower halves and the longitudinally extending marginal portions 58 of the cover plate 6 form similar troughs which surround the upper halves of adjacent portions of the frame members 2. The housing 4 is rigid with the frame 54.

The front portion of the space between the plates 5 and 6 is filled or practically filled by an insert 7 consisting of suitable synthetic plastic material having a low coefficient of friction. That portion of the cover plate 6 which is located above the insert 7 has an opening or cutout 12 for the carriage 3. The suitably bent front and rear edge portions 8, 9 of the carriage 3 extend below and are slidable along complementary transverse edge portions 10, 11 of the cover plate 6. The opening 12 is disposed between the edge portion 10, 11. The carriage 3 can move substantially transversely of the frame 54 and housing 4 whereby it slides along the upper side of the friction reducing plastic insert 7 and its path is defined by the edge portions 10, 11 of the cover plate 6. Such mounting and guidance insures that the carriage 3 is unlikely to jam, i.e., that it will move along the path defined by the edge portions 10, 11 as soon as it is disengaged from the aforementioned connecting means.

The edge portions 8, 9 cooperate with the respective edge portions 10, 11 of the cover plate 6 to guide the carriage 3 during movement substantially at right angles to the skiing direction 41. In addition, the housing 4 contains further friction-reducing or low-friction guides at the front and rear end faces of the edge portions 8 and 9. The front guide comprises a set of rollers 13 mounted in the housing 4 forwardly of the opening 12, and the rear guide comprises two rollers 14 each adjacent to a different frame member 2 and also mounted in the interior of the housing 4. The rollers 13 take up stresses which act in the skiing direction 41*a* and arise as a result of engagement of the ski boot by the hold-down devices 27 and 44. Each of the rollers 13 is rotatable in the housing 4 about a fixed vertical axis and is urged forwardly by the edge portion 8 which, in turn, is urged forwardly by the boot whose front portion bears against the hold-down device 27 on the carriage 3 under the action of one or more resilient elements in the rear hold-down device 44.

The rear rollers 14 are urged forwardly by a pair of helical springs 19 forming part of a set 20 of elongated springs mounted in the rear portion of the housing 4. These rollers are received in longitudinally extending slots 15 of the plates 5, 6 and bear against the rear edge portion 9 of the carriage 3. In order to prevent them from moving axially, the rollers 14 are provided with upper and lower enlarged portions or flanges 17, 16 which respectively overlie the upper side of the cover plate 6 and the underside of the bottom plate 5. Thus, each roller 14 can be said to resemble a reel or spool having a core which is reciprocable in the respective pair of slots 15 in the housing 14.

Figure 3:
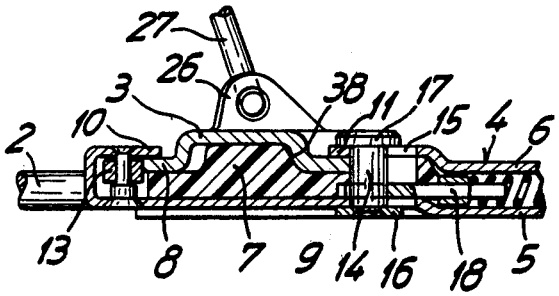
FIG. 3 is a fragmentary longitudinal vertical sectional view as seen in the direction of arrows from the line III—III of FIG. 1.

The cores of the rollers 14 are urged forwardly by pushers 18 having bifurcated front portions 25 which straddle the respective cores above the bottom plate 5 (see FIG. 3). The rear portions 24 of the pushers 18 extend into the foremost convolutions of the respective springs 19. These springs bear against the shoulders 23 of the respective pushers 18.

Figure 1:
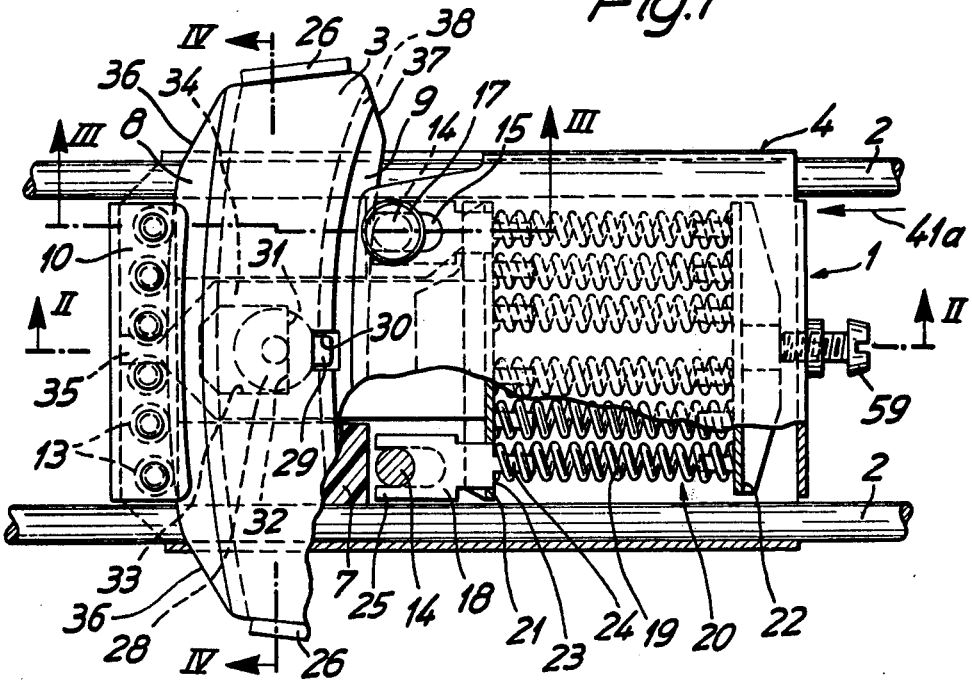
FIG. 1 is a fragmentary plan view of a ski binding including a safety device which embodies one form of the invention and a fragmentary plan view of a cross country frame which secures the binding to a ski, portions of the safety device being broken away.

The rear portions of the springs 19 surround guide posts forming part of a rear spring retainer 22 which may be fixed to the housing 4 or may be adjustably mounted therein in a manner as shown in FIG. 1. By rotating an adjusting screw 59 which meshes with the housing 4, the user can move the rear retainer 22 forwardly (to increase the bias of the springs 19) or allows the springs 19 to move the retainer 22 counter to the skiing direction 41*a*. The springs 19 react against the retainer 22 and bear against the pushers 18 or against a front retainer 21. The latter has guide slots for the pushers 18 so that each of these pushers (and the corresponding roller 14) is biased forwardly by a single spring 19.

The axes of the front rollers 13 are disposed on an arc whose radius of curvature equals or approximates the average length of a ski boot. This insures that the ski boot does not move laterally relative to the carriage 3 or vice versa, even if the hold-down device 27 is not very tight or is accidentally released. The same applies if the improved safety device 1 is mounted on the rear portion of the frame 54 (see FIG. 13). If the device 1 is mounted in a manner as shown in FIG. 13, the rollers 13 are located behind the rollers 14, i.e., the device 1 of FIG. 13 can be said to be a mirror image of the device 1 of FIG. 12. The rollers 14 are always nearer to the center of the boot.

The hold-down device 17 has a yoke whose end portions are turnable is coupling members (e.g., eyelets) 26 of the carriage 3. If the device 1 is mounted in a manner as shown in FIG. 13, the eyelets 26 are coupled to the end portions of the yoke 45 forming part of the hold-down device 44. In other words, one of the hold-down devices 27, 44 is always coupled directly to the carriage 3. Since the hold-down device 17, 44 are pivotable relative to the carriage 3 or relative to the frame 54, they can properly engage and hold ski boots having soles whose thickness may vary within a wide range. The hold-down device 44 is designed to release the heel of a ski boot in response to the application of a predetermined force which tends to move the heel away from the upper side of the ski 41.

The means for releasably or separably and yieldably connecting the carriage to the housing 4 comprises the aforementioned springs 19 (and more particularly the springs 19 between the two outermost springs which bias the rollers 14), the front retainer 21, a slidable locking bolt 34 which is connected to and may be considered a component part of the retainer 21, and an eccentric 28 which is rotatably mounted in the housing 4 and has a projection or lobe 29 normally extending rearwardly into a socket 30 machined into the median part of an arcuate portion 38 of the carriage 3. The eccentric 28 is rotatable in the base plate 5 and insert 7 of the housing 4. The lobe 29 is provided on the cylindrical upper portion of the eccentric 28 and the latter further includes a lower portion having a facet or flat 31 which includes or is close to the axis of the cylindrical portion of the eccentric. The flat 31 normally abuts against a flat face 32 bounding the rear end of a cutout or window 33 in the locking bolt 34. In the embodiment of FIGS. 1–4, the front portion of the retainer 21 constitutes a flat pocket for the rear portion of the locking bolt 34. The front portion 35 of the bolt 34 extends well beyond the window 33 and is slidably received between the shafts of two rollers 13 (e.g., between the shafts of the two centrally located rollers 13). The bolt 34 is slidable in a complementary passage or channel of the plastic insert 7 above the base plate 5 (see FIG. 2).

The operation:

If the ski boot whose sole and heel are respectively clamped by the hold-down devices 27 and 44 transmits to the carriage 3 stresses which act transversely of the skiing direction 41*a* and whose magnitude exceeds a preselected value (see the adjusting screw 59), the carriage 3 moves upwardly or downwardly (as viewed in FIG. 1) whereby one of the surfaces surrounding the socket 30 turns the eccentric 28 through the medium of the lobe 29. The eccentric 28 causes its flat 31 to push the locking bolt 34 and the front retainer 21 rearwardly against the opposition of the respective springs 19. If the magnitude of stresses is below the preselected value, the springs 19 of the set 20 resist the rearward movement of retainer 21 and bolt 34 so that the face 32 at the rear end of the window 33 prevents such angular displacement of the eccentric 28 as is necessary to enable the socket 30 to move away from the lobe 29. In fact, the springs 19 enable the locking bolt 34 to return the eccentric 28 to the neutral position of FIG. 1 in which the lobe 29 is fully received in the socket 30.

If the stresses upon the carriage 3 suffice to expel the lobe 29 from the socket 30, the lobe engages the front side of the arcuate (convex) portion 38 of the carriage 3. The curvature of the front side of the portion 38 is more pronounced than the curvature of the aforementioned arc formed by the axes of the rolls 13 so that the distance between the portion 38 and the eccentric 28 increases in response to continued movement of the carriage 3 from its normal or operative position (in which the lobe 29 extends into the socket 30). Consequently, the bias of the eccentric 28 upon the carriage 3 decreases proportionally with the extent of movement of carriage from the operative position. This is desirable on several grounds, i.e., once the carriage 3 leaves its operative position, it offers less and less resistance to turning of the ski boot relative to the ski; furthermore, movement of the carriage 3 back to the operative position necessitates the exertion of a relatively small force.

In order to prevent the carriage 3 from becoming lost (e.g., in the snow) upon complete disengagement from the housing 4, the binding preferably comprises a cable, chain, cord or another suitable flexible element whose ends are respectively secured to the carriage and to the housing 4, ski 41 or frame 54.

Reinsertion of the carriage 3 into the housing 4 is facilitated by the provision of suitably inclined cam faces 36, 37 at both lateral ends of the carriage. One pair of these cam faces is introduced between the respective outermost roller 13 and the corresponding roller 14. Since each of the rollers 14 is biased by a single spring 19, the reintroduction of the carriage 3 into the housing 4 necessitates the exertion of a relatively small effort. As mentioned above, pronounced curvature of the front side of the portion 38 also contributes to convenience of reinsertion of the carriage. The portion 38 slides along the lobe 29 until the latter reenters the socket 30 (which is machined into or otherwise formed in the portion 38). The rollers 14 move backwardly while the socket 30 moves toward the lobe 29.

Figure 5:
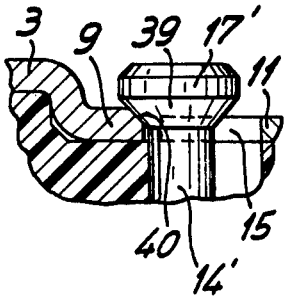
FIG. 5 is an enlarged fragmentary longitudinal vertical sectional view of a modified safety device.

FIG. 5 shows a portion of a modified safety device which allows for detachment of the carriage 3 in a manner as described in connection with FIGS. 1–4 (i.e., by shifting the carriage sideways in a substantially horizontal plane and substantially at right angles to the longitudinal direction of the ski) as well as upwardly and away from the upper side of the ski. To this end, the edge portion 11 of the cover plate is recessed to such an extent that it does not overlie the rear edge portion 9 of the carriage. Also, the safety device of FIG. 5 employs modified rollers 14′ (one shown) whose upper flanges 17′ have downwardly tapering conical portions 39 abutting against a complementary surface 40 of the edge portion 9. The portions 39 of the flange 17′ normally overlie the surface 40. The manner in which the cores of the spoollike or reel-shpaed rollers 14′ are coupled to the respective springs 19 (not shown in FIG. 5) is the same as described in connection with the safety device 1 of FIGS. 1–4.

Figure 11:
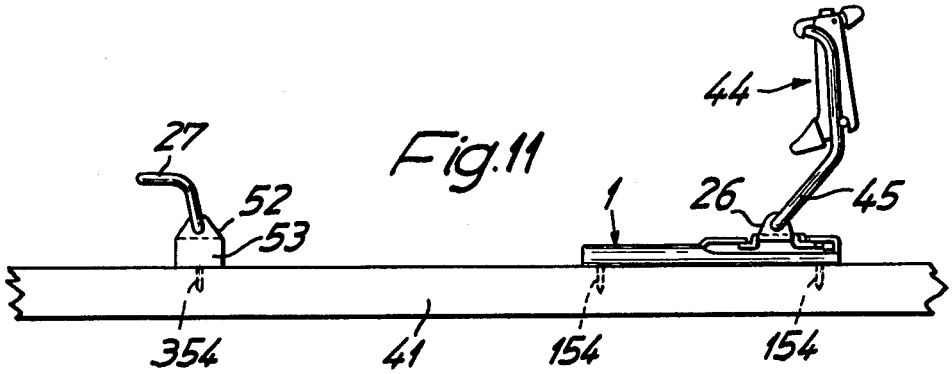
FIG. 11 is a similar fragmentary side elevational view of a ski and of a binding whose safety device is mounted directly on the ski in the region of the heel of a ski boot.

An advantage of the safety device which embodies the carriage and rollers 14′ of FIG. 5 is that the carriage can be detached from the housing in a manner as described in connection with FIGS. 1–4 as well as by moving at right angles to and away from the upper side of the ski, even though the number of parts in the safety device of FIG. 5 is the same as that in the safety device of FIGS. 1–4. Furthermore, the relatively complex hold-down device for the heel if the safety device embodying the features of FIG. 5 is mounted in a manner as shown in FIG. 11 or 13, i.e., below the heel of a ski boot.

When the hold-down device 27 or 44 (not shown in FIG. 5) which is articulately connected to the carriage 3 of FIG. 5 is urged upwardly and away from the ski with a predetermined force, the surface 40 of the carriage 3 urges the rollers 14′ rearwardly (to the right, as viewed in FIG. 5) so that the surface 40 is free to slide upwardly and past the conical portions 39 and thus enables the carriage to become disengaged from the housing. This will be readily understood by referring again to FIG. 2 since, once the rear edge portion 9 of the carriage 3 is free to rise, its front edge portion 8 can slide out of the space below the edge portion 10 of the cover plate 6. It can be said that the rollers 14′, the respective springs 19 and the pushers 18 constitute a second means for yieldably and releasably connecting the carriage 3 to the housing 4 in such a way that the connection is terminated in response to the application of a predetermined force acting upon the carriage and tending to move the latter upwardly and away from the ski. Such second connecting means is desirable and advantageous because it can prevent injury or reduces the likelihood of serious injury when the skier falls forwardly, especially when the safety device embodying the rollers 14′ of FIG. 5 is mounted on the rear portion of the frame 54 (see FIG. 13). In such instances, the rear hold-down device 44 can be replaced with a rudimentary or relatively simple hold-down device which need not become disengaged from the heel portion of a ski boot unless the user so desires. In other words, the rear hold-down device then merely performs the function of a simple coupling which releasably secures the heel to the carriage 3 but does not or need not release the heel in the event of an accident because the heel is released by disengagement of the carriage 3 from the housing 4 in a manner as described in connection with FIG. 5.

Figure 10:
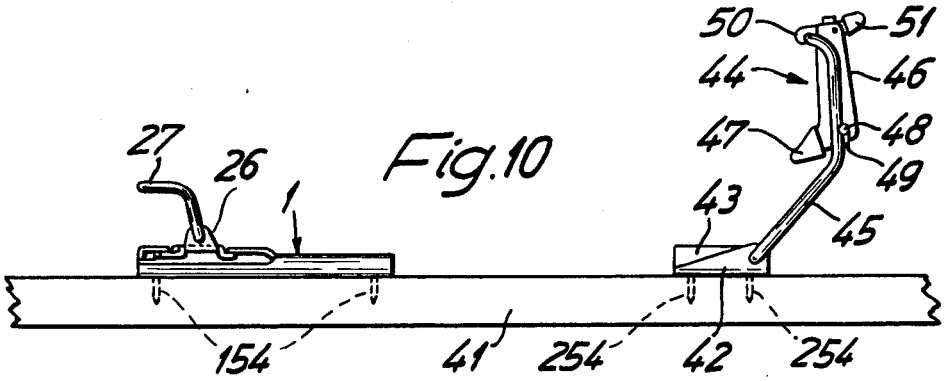
FIG. 10 is a fragmentary side elevational view of a ski and of a binding whose safety device is mounted directly on the ski in the region of the front end of a ski boot.

As mentioned above, the marginal portions 57, 58 of the base plate 5 and cover plate 6 are secured to adjacent portions of the frame members 2. Thus, the frame 54 constitutes a means for securing the housing 4 of the safety device 1 to the ski 41. If the frame 54 is omitted, the support or housing of the safety device is mounted directly on the ski 41 (see FIG. 10), e.g., by means of screws 154 or the like. Thus, the screws 154 constitute a modified means for securing the housing of the safety device to the ski. The carriage of the safety device 1 of FIG. 10 is articulately coupled (by 26) to the front hold-down device 27. The heel plate 43 is secured to the ski 41 behind the safety device 1 (e.g., by means of screws 254 or analogous securing means) and its bearing members 42 articulately support the yoke 45 of the rear hold-down device 44.

The housing of the safety device 1 of FIG. 10 can be secured to the ski 41 by four screws 154, one at each corner of the housing.

FIG. 11 shows that the housing of the safety device 1 is secured to the ski 41 (by screws 154) behind the front hold-down device 27. The coupling members 26 of the carriage in the safety device 1 of FIG. 11 pivotably support the yoke 45 of the rear hold-down device 44. The front hold-down device 27 is pivotable in coupling members (e.g., eyelets) 52 of a bracket 53 which is secured to the ski 41 by screws 354. The median portion or web of the substantially U-shaped bracket 53 constitutes a rest for the front portion of the sole of a ski boot.

An important advantage of the improved safety device is that one of the hold-down devices 27, 44 is directly coupled to the carriage 3, that the front end rear edge portions 8, 9 of the carriage engage friction reducing elements (13, 14) of the guide means, and that the means for yieldably and releasably connecting the carriage to the housing or support 4 includes first (30, 38) and second (19, 21, 34, 28) components which are provided solely on the carriage and on or in the housing. In other words, and in contrast to the binding which is disclosed in the aforementioned German Anslegeschrift No. 1,201,738, the components of connecting means in or on the housing 4 cooperate directly and exclusively with the components of connecting means on the carriage 3. Thus, and since a portion of the carriage 3 directly supports the adjacent portion (the heel or a part of the sole) of a ski boot, the carriage constitutes an important element of the safety device 1. In the binding of the Auslegeschrift, the boot cooperates with the hold-down device on the jaw and the plate of the patented binding can become disengaged from the ski only after pivoted movement of the jaw from its operative position.

Since the connecting components on the housing 4 cooperate directly with connecting components of the carriage 3, and since the edge portions 8, 9 of the carriage engage friction reducing elements 13, 14 of the guide means, the magnitude of the force which is needed to effect disengagement of the carriage from the housing remains unchanged, i.e., once the user selects the force by appropriate adjustment of the retainer 22, the force remains unchanged even if the bias of the rollers 14 upon the edge portion 9 and/or the bias of the portion 8 upon the rollers 13 fluctuates within a wide range. Also, the carriage 3 is (or can be made) so small that the housing or support 4 can be sufficiently compact to avoid undue stiffening of adjacent portion of the ski. Moreover, compactness of the carriage 3 and its housing 4 renders it possible to reduce the bulk and weight of the safety device 1 as well as of the entire binding which embodies the safety device. This is of particular importance in bindings for use on cross country skis, i.e., for use by long-distance skiers.

The carriage 3 may constitute a simple substantially flat plate, a plate having a more complex profile, or an assemblage of two or more parts, as long as the carriage can support a portion of a boot and can support the front or the rear hold-down device. The rollers 13 and/or 14 for the edge portions 8, 9 of the carriage can be replaced by linings having a low coefficient of friction, spheres or other types of friction reducing elements. The linings can be released into the edge portions 8, 9 into the edge portions 10, 11 and/or other portions of the housing. Also, the rollers 13 and/or 14 can be replaced by antifriction ball or roller bearings. If the rollers 14 are replaced by bearings whose outer cages engage the edge portion 9 of the carriage 3, such bearings are preferably reciprocable in and counter to the skiing direction, the same as the rollers 14. For example, the rollers 14 can be replaced by bearings of the type shown in FIG. 9. In either event, the housing 4 and/or the rollers or bearings must have means (such as the flanges 16, 17) for preventing the rollers or bearings from leaving the housing when the carriage is removed from the path defined by the edge portions 10, 11, the insert 7 and the friction reducing elements.

The placing of the eccentric 28 below the carriage 3 results in additional savings in space and thus contributes to compactness of the safety device. The same applies for the mounting of the retainers 21, 22, bolt 34, springs 19 and pushers 18 in the interior of the housing 4. The placing of the bolt 34 into the space below the carriage reduces the length of the safety device.

The eccentric 28 can be mounted behind the portion 38 of the carriage 3. The curvature of the portion 38 is then less pronounced than that of the curve passing across the axes of the rollers 13. The result is the same, i.e., the pressure of the eccentric 28 upon the portion 38 decreases in response to greater lateral shifting of the carriage from its neutral or operative position. During reintroduction of carriage 3 into the housing 4, the portion 38 acts not unlike a ramp and facilitates the movement of the socket 30 back into register with the lobe 29 of the eccentric 28.

The provision of means (the two outermost springs 19) for biasing the rollers 14 (i.e., those rollers which are nearer to the center of the boot) is an optional but highly advantageous feature of the safety device. This facilitates the reinsertion of carriage 3 into the housing 4. It is preferred to mount the rollers 14 (i.e., to select the length of slots 15) in such a way that these rollers can move in and counter to the direction 41*a* through a distance which equals or approximates the length of the lobe 29 (as considered in the radial direction of the upper portion of the eccentric 28). This insures that the angular position of the eccentric cannot be changed by the carriage to such an extent that the bolt 34 would be unable to automatically return the eccentric to the position of FIG. 1 as soon as the carriage is fully separated from the housing. Furthermore, the carriage 3 can be reinserted into the housing without any shifting of the bolt 34, i.e., the bias of the majority of springs 19 remains unchanged because the carriage merely stresses those springs which bias the rollers 14.

The springs 19 could be replaced by a smaller number of larger-diameter springs or by a single package of dished springs. The structure of FIGS. 1–4 is preferred at this time because it contributes to compactness of the safety device, as considered at right angles to the upper side of the ski. Thus, the relatively large number of small-diameter springs 19 can be readily accommodated in the space between the frame members 2 so that only the carriage 3 and its hold-down device 27 or 44 extend upwardly and beyond the frame 54. The carriage 3 must be located at a level above the frame 54 because it must have room for complete disengagement from the housing or support 4. However, the carriage is normally rather thin so that the combined height of the frame 54 plus the safety device 1 is only slightly greater than the height or thickness of the frame alone. The carriage of FIGS. 1–4 is a simple plate whose central portion supports a portion of the sole or heel of a ski boot and whose edge portions 8, 9 are bent downwardly to fit below the edge portions 10, 11 of the cover plate 6.

By employing a large number of springs, certain springs can be used to perform different functions, i.e., to bias the rollers 14 against the edge portion 9. The remaining springs 19 suffice to bias the bolt 34 against the lower portion of the eccentric 28 with a desired force.

The hold-down device 27 may constitute a simple yoke consisting of metallic wire and being pivotable between any desired number of positions, depending on the thickness of the tip of the sole of a ski boot or an article of footwear other than a ski boot (e.g., a boot of the type used by mountain climbers).

FIGS. 6 to 9 show a third safety device. All such parts of this safety device which are identical with or clearly analogous to corresponding parts of the safety device 1 of FIGS. 1–4 are denoted by similar reference characters.

Figure 6:
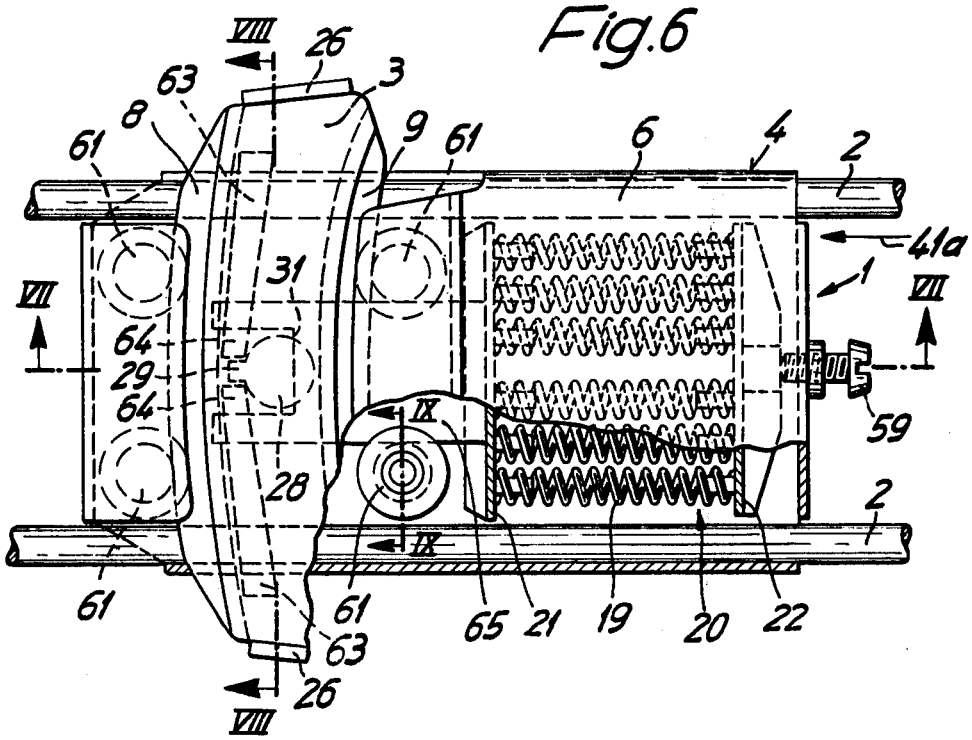
FIG. 6 is a fragmentary plan view of a binding including a third safety device and a fragmentary plan view of a frame for the binding, portions of the safety device being broken away.

The cover plate 6 of the housing or support 4 has an opening 12 for the boot-supporting central portion of the carriage 3. The front and rear edge portions 8 and 9 do not engage the cover plate 6; instead, they extend into circumferential grooves 60 of the two pairs of anti-friction roller bearings 61. As shown in FIG. 6, two roller bearings 61 are installed in the foremost part of the housing 4 adjacent the frame members 2, and two roller bearings 61 are adjacent the frame members 2 behind the opening 12 in the cover plate 6. The carriage 3 is supported exclusively by the four bearings 61, i.e., these bearings take up all stresses which are transmitted to the carriage by the sole or heel of a ski boot as well as by the hold-down device 27 (shown in FIG. 7) or 44 (see FIG. 13) and tend to move the carriage toward or away from the upper side of the ski or in or counter to the skiing direction. Such stresses include the weight of the skier, the bias of resilient means in the rear hold-down device 44, forces which develop during skiing, as well as forces which develop in the course of a fall or accident. The carriage 3 of FIGS. 6 to 9 can become separated from the housing 4 only by moving in a substantially horizontal plane transversely of the skiing direction 41*a*. The edge portions 8 and 9 then move upwardly or downwardly, as viewed in FIG. 6, i.e., at right angles to the plane of FIG. 7. The friction reducing roller bearings 61 have downwardly extending central portions 62 in the form of studs which are anchored in the base plate 5 of the housing 4. The material of central portions 62 can be deformable so that each such portion can be converted into a rivet head. Each central portion 62 is integral with the inner race 66 of the respective roller bearing 61. The axes of these bearings are normal to the upper side of the ski when the frame 54 including the members 2 lies flat against such upper side.

Figure 8:
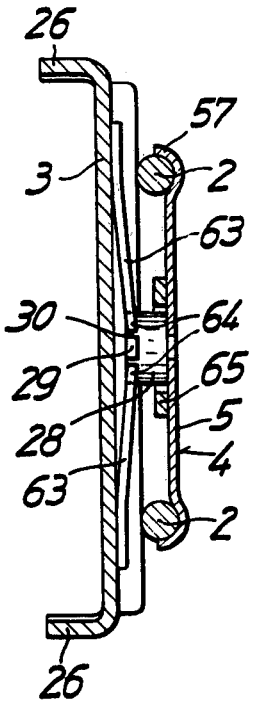
FIG. 8 is a transverse vertical sectional view as seen in the direction of arrows from the line VIII—VIII of FIG. 6.

The lobe 29 of the eccentric 28 cooperates with two leaf springs 63 whose outer end portions are affixed to the carriage 3 and whose inner end portions 64 define a gap or socket 30 normally snugly receiving the lobe 29. FIG. 8 shows that the springs 63 slope downwardly from their outer end portions toward the socket 30; i.e., the inner end portions 64 are spaced apart from the underside of the carriage. When the carriage 3 is shifted sideways, one of the end portions 64 turns the eccentric 28 via lobe 29. The flat 31 of the eccentric 28 normally abuts against the complementary flat surface of a locking bolt 65 which extends in the longitudinal direction of the ski and is urged forwardly by the front retainer 21. The rear retainer 22 for the set 20 of springs 19 abuts against the tip of the adjusting screw 59 which can be rotated to change the initial stressing of the springs 19 and hence the force which is needed to turn the eccentric 28.

The operation of the safety device 1 of FIGS. 6–9 is analogous to that of the safety device which is shown in FIGS. 1–4. When the carriage 3 is subjected to lateral stresses whose magnitude suffices to enable the end portion 64 of one of the leaf springs 63 to turn the eccentric 28 via lobe 29, the flat 31 of the eccentric pushes the locking bolt 65 rearwardly to stress the springs 19. The maximum angular movement of the eccentric 28 is such that it can still return to the normal position of FIG. 6 under the action of the locking bolt 65 (this also applies for the eccentric 28 and locking bolt 34 of FIGS. 1 to 4).

Figure 7:
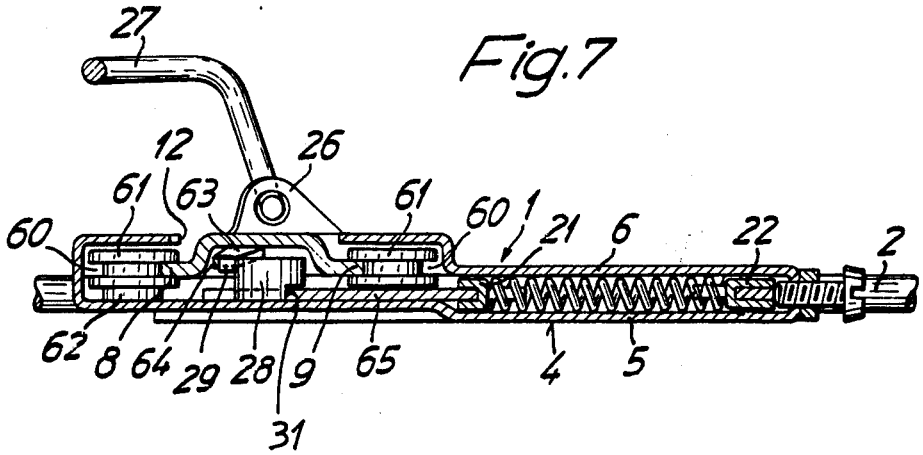
FIG. 7 is a longitudinal vertical sectional view as seen in the direction of arrows from the line VII—VII of FIG. 6.

When the carriage 3 of FIGS. 6 to 8 is reintroduced into the housing 4, the angular position of the eccentric 28 need not be changed at all, i.e., the eccentric 28 simply remains in the normal position of FIG. 6 to which it returns, under the action of the springs 19 and bolt 65, as soon as the carriage 3 is withdrawn from the opening 12 of the housing. This is due to the aforedescribed configuration and mounting of the leaf springs 63 which can be said to constitute portions of the carriage. During reintroduction of the carriage 3, the operator simply inserts the ends of the edge portions 8 and 9 into the circumferential grooves 60 of the adjacent roller bearings 61. The operator thereupon pushes the carriage 3 back toward the operative or neutral position whereby one of the leaf springs 63 undergoes some deformation by sliding along the lobe 29 of the eccentric 28. Such deformation of one of the leaf springs 63 necessitates the exertion of a relatively small force. The inner end portion 64 of the one leaf spring 63 snaps downwardly and behind the lobe 29 as soon as the carriage 3 reaches the neutral position of FIG. 6.

Figure 9:
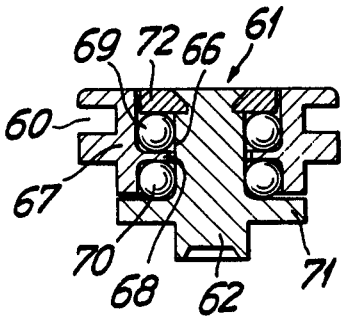
FIG. 9 is an enlarged vertical sectional view as seen in the direction of arrows from the line IX—IX of FIG. 6.

The construction of one of the four roller bearings 61 is shown in FIG. 9. The central portion 62 of this roller bearing is shown prior to anchoring in the base plate 5, i.e., prior to deformation of its lower end so that it overlies the underside of the base plate around the hole for the central portion 62. The inner race 66 of the central portion is coaxial with an outer race 67 which is located above an annular flange 71 of the central portion 62 and has an inwardly extending collar or partition 68 between two annuli of spherical rolling elements 69, 70 surrounding the inner race 66. The flange 71 (on which the rolling elements 70 rest) is preferably integral with the central portion 62. A second flange 72 overlies the rolling elements 69 and is preferably permanently secured to the central portion 62, e.g., by upsetting the upper end of the portion 62. The groove 60 is machined into the periphery of the outer race 67.

It has been found that two roller bearings 61 in front of the edge portion 8 and two roller bearings behind the opening 12 suffice to safely guide the carriage 3 and to withstand all stresses acting in or counter to the skiing direction 41*a* as well as at right angles to the upper side of the ski. The resistance which the bearings 61 offer to movement of the edge portions 8 and 9 transversely of the direction 41*a* in a plane which is parallel to the upper side of the ski is negligible, even if the forces acting in or counter to the direction 41*a* and at right angles to the upper side of the ski fluctuate within an extremely wide range.

Referring again to FIGS. 12 and 13, the frame 54 can be replaced by a much simpler frame, e.g., by a metallic or plastic plate whose front portion is articulately connected to the ski 41 if the improved safety ski binding is intended to be used for cross country skiing, or which can be screwed or bolted to the ski if the binding is intended primarily or exclusively for downhill skiing.

Figure 12:
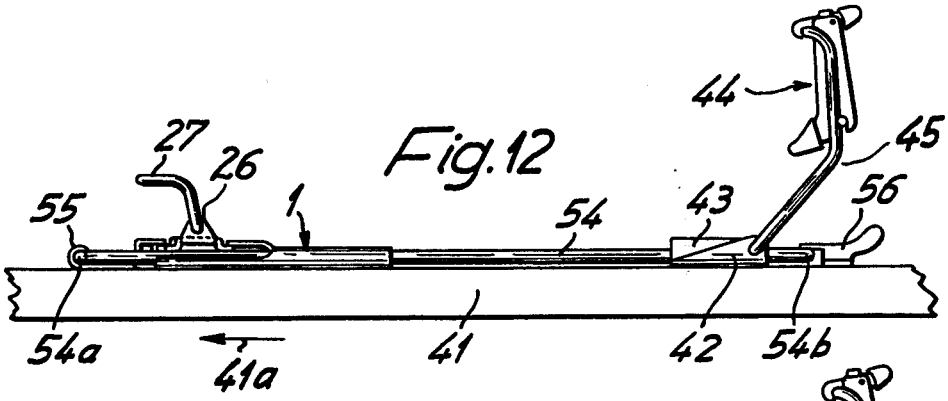
FIG. 12 is a similar fragmentary side elevational view of a ski and of a binding which is mounted on a pivotable cross country frame and whose safety device is located in the region of the front end of a ski boot.
Figure 13:
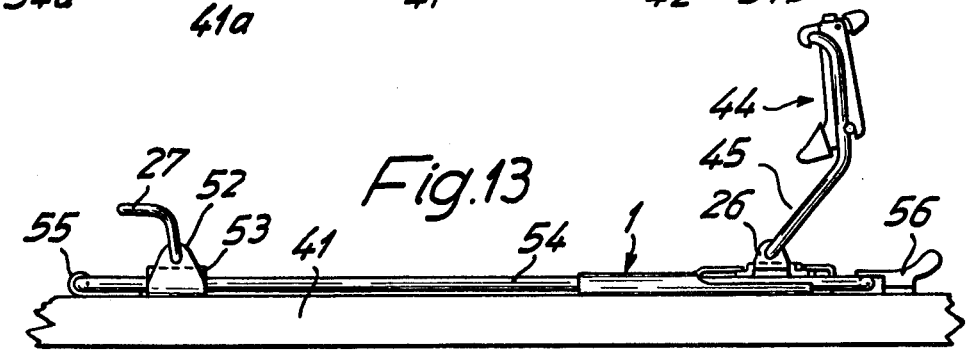
FIG. 13 illustrates the structure of FIG. 12 but with the safety device mounted on the frame in the region of the heel of a ski boot.

In FIG. 12, the negligible thickness of the safety device 1 renders it possible to mount the front hold-down device 27 in such a way that the tip of the ski boot is in line with the axis of the hinge including the pintle 54*a* and leaf 55. This is highly desirable in bindings for cross country skiing because the rear part of the ski 41 need not be lifted above the ground when the ski boot pivots the frame 54 in a counterclockwise direction preparatory to pushing or pulling of the ski forwardly. The pawl 56 is caused to engage the traverse 54*b* at the rear end of the frame 54 when the skier expects to travel downhill.

The rear hold-down device 44 of FIG. 13 can be replaced with a simpler hold-down device if the safety device 1 embodies the feature which is shown in FIG. 5. The front hold-down device 27 is preferably mounted in such a way that the tip of the sole of the ski boot is in line with the pivot axis of the hinge including the leaf 55.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. A safety ski binding, comprising a support; means for securing said support to a ski; a carriage having a boot-supporting portion; guide means provided on said support and defining for said carriage a path extending substantially transversely of the skiing direction; means for yieldably connecting said carriage to said support so that the carriage is fully separable from said support by moving, in its entirety, along said path in response to the application of a predetermined force; discrete hold-down devices for the front and rear ends of a ski boot; and means for coupling only one of said hold-down devices to said carriage.

2. A binding as defined in claim 1, wherein said connecting means includes cooperating first and second components respectively provided solely on said carriage and said support and normally maintaining said carriage in a neutral position above the upper side of the ski carrying said support, said guide means including friction reducing elements on said support.

3. A binding as defined in claim 2, wherein said friction reducing elements include rotary elements.

4. A binding as defined in claim 3, wherein said rotary elements include rollers.

5. A binding as defined in claim 3, wherein said rotary elements include spheres.

6. A binding as defined in claim 2, wherein said friction reducing elements include liners.

7. A binding as defined in claim 2, wherein said friction reducing elements include roller bearings.

8. A binding as defined in claim 7, further comprising means for biasing said bearings against said carriage.

9. A binding as defined in claim 2, wherein said second component of said connecting means comprises an eccentric rotatably mounted in said support and having a projection and means for yieldably opposing rotation of said eccentric from a predetermined angular position, said first component including a socket provided in said carriage and receiving said projection in said predetermined angular position of said eccentric.

10. A binding as defined in claim 2, wherein said friction reducing elements include a first group nearer to and a second group remote from said hold-down device, and further comprising means for biasing the friction reducing elements of said second group against said carriage.

11. A binding as defined in claim 2, wherein said friction reducing elements include a group of elements movable in and counter to the skiing direction and further comprising means for biasing the elements of said group against said carriage.

12. A binding as defined in claim 11, wherein said biasing means comprises prestressed helical springs having axes which are substantially parallel to the skiing direction.

13. A binding as defined in claim 11, further comprising pushers interposed between said helical springs and the respective elements of said group.

14. A binding as defined in claim 13, wherein said second component of said connecting means comprises additional helical springs substantially parallel to said first mentioned springs and a retainer disposed between said springs and said carriage, said retainer having cut-outs for said pushers.

15. A binding as defined in claim 1, wherein said one hold-down device is arranged to engage the tip of the sole of a ski boot and said coupling means defines for said one hold-down device a pivot axis extending transversely of the skiing direction.

16. A binding as defined in claim 1, wherein said securing means includes a cross country frame having a front end portion pivoted to the ski and two elongated lateral frame members extending in the skiing direction, said carriage and said one hold-down device extending upwardly and beyond said frame members and said support and said connecting means being disposed between said frame members.

17. A binding as defined in claim 1, wherein said support includes a hollow housing for said connecting means.

18. A binding as defined in claim 17, wherein said housing includes at least one edge portion defining a first portion of said path and said support further includes friction reducing elements installed in said housing and defining the remaining portion of said path.

19. A safety ski binding, comprising a support; means for securing said support to a ski; a carriage having a boot-supporting portion and front and rear edge portions, as considered in the skiing direction; guide means provided on said support and defining for said carriage a path extending substantially transversely of the skiing direction; means for yieldably connecting said carriage to said support so that the carriage is fully separable from said support by moving along said path in response to the application of a predetermined force, said connecting means including cooperating first and second components respectively provided solely on said carriage and said support and normally maintaining said carriage in a neutral position above the upper side of the ski carrying said support, said guide means including friction reducing elements on said support and said friction reducing elements including first and second roller bearings having circumferential grooves respectively receiving parts of said front and rear edge portions of said carriage; a hold-down device for one end of a ski boot; and means for coupling said hold-down device to said carriage.

20. A binding as defined in claim 19, wherein said roller bearings have fixed axes which are substantially normal to the upper side of the ski carrying said support so that said bearings hold said carriage against any movement except in a direction substantially transversely of the skiing direction in a plane which is substantially parallel to the upper side of the ski.

21. A binding as defined in claim 20, wherein said roller bearings have inner races fixed to said support and outer races rotatably surrounding the respective inner races, said grooves being provided in the peripheries of said outer races.

22. A binding as defined in claim 21, wherein said first bearings include two roller bearings for said front edge portion and two roller bearings for said rear edge portion of said carriage.

23. A binding as defined in claim 19, wherein each of said bearings includes a central portion affixed to said support and having an inner race and first and second flanges at the opposite axial ends of said inner race, an outer race rotatably surrounding said inner race between said flanges and having an inwardly extending collar intermediate said flanges, and annuli of rolling elements between said collar and said flanges, said grooves being provided in the peripheries of said outer races.

24. A binding as defined in claim 19, wherein said securing means comprises a frame having a front end portion pivoted to the upper side of the ski.

25. A safety ski binding, comprising a support; means for securing said support to a ski; a carriage having a boot-supporting portion; guide means provided on said support and defining for said carriage a path extending substantially transversely of the skiing direction, said guide means including friction reducing elements on said support; means for yieldably connecting said carriage to said support so that the carriage is fully separable from said support by moving along said path in response to the application of a predetermined force, said connecting means including cooperating first and second components respectively provided solely on said carriage and said support and normally maintaining said carriage in a neutral position above the upper side of the ski carrying said support, said second component of said connecting means comprising an eccentric rotatably mounted in said support and having a projection, and means for yieldably opposing rotation of said eccentric from a predetermined angular position, said first component including a socket provided in said carriage and receiving said projection is said predetermined angular position of said eccentric, said opposing means including a first flat on said eccentric, a locking member having a second flat abutting against said first flat in said predetermined angular position of said eccentric and resilient means mounted in said support and urging said second flat against said first flat; a hold-down device for one end of a ski boot; and means for coupling said hold-down device to said carriage.

26. A binding as defined in claim 25, wherein said eccentric is located between said carriage and the upper side of the ski which carries said support, said locking member being reciprocable in said support in and counter to the skiing direction.

27. A safety ski binding, comprising a support; means for securing said support to a ski; a carriage having a boot-supporting portion; guide means provided on said support and defining for said carriage a path extending substantially transversely of the skiing direction, said guide means including friction reducing elements on said support; means for yieldably connecting said carriage to said support so that the carriage is fully separable from said support by moving along said path in response to the application of a predetermined force, said connecting means including cooperating first and second components respectively provided solely on said carriage and said support and normally maintaining said carriage in a neutral position above the upper side of the ski carrying said support, said second component comprising an eccentric rotatably mounted on said support and having a projection and means for yieldably opposing rotation of said projection from a predetermined angular position, said first component including a socket provided in said carriage and receiving said projection in said predetermined angular position of said eccentric; a hold-down device for one end of a ski boot; and means for coupling said hold-down device to said carriage, said path being an arcuate path having a center of curvature located at the other end of the ski boot whose one end is engaged by said hold-down device, said carriage further including an arcuate portion defining said socket and having a curvature different from the curvature of said path, said projection bearing against said arcuate portion of said carriage upon expulsion from said socket in response to the application of said predetermined force against said carriage.

28. A safety ski binding, comprising a support; means for securing said support to a ski; a carriage having a boot-supporting portion; guide means provided on said support and defining for said carriage a path extending substantially transversely of the skiing direction, said guide means including friction reducing elements on said support; means for yieldably connecting said carriage to said support so that the carriage is fully separable from said support by moving along said path in response to the application of a predetermined force, said connecting means including cooperating first and second components respectively provided solely on said carriage and said support and normally maintaining said carriage in a neutral position above the upper side of the ski carrying said support, said second component comprising an eccentric rotatably mounted in said support and having a projection and means for yieldably opposing rotation of said eccentric from a predetermined angular position, said first component including a socket provided in said carriage and receiving said projection in said predetermined angular position of said eccentric, said carriage having an underside facing the upper side of the ski which carries said support and said carriage further including two leaf springs having outer portions affixed to said underside and inner portions defining said socket, said springs sloping away from said underside in directions from said outer toward said inner portions thereof; a hold-down device for one end of a ski boot; and means for coupling said hold-down device to said carriage.

29. A safety ski binding, comprising a support; means for securing said support to a ski; a carriage having a boot-supporting portion; guide means provided on said support and defining for said carriage a path extending substantially transversely of the skiing direction, said guide means including friction reducing elements on said support; means for yieldably connecting said carriage to said support so that the carriage is fully separable from said support by moving along said path in response to the application of a predetermined force, said connecting means including cooperating first and second components respectively provided solely on said carriage and said support and normally maintaining said carriage in a neutral position above the upper side of the ski carrying said support; a hold-down device for one end of a ski boot; means for coupling said hold-down device to said carriage, said friction reducing means including a first group nearer to and a second group remote from said hold-down device; and means for biasing the friction reducing elements of said second group against said carriage, said second component of said connecting means including the elements of said second group and said biasing means and said first component of said connecting means including a surface provided on said carriage and normally abutting against the elements of said second group, said surface being arranged to displace the elements of said second group against the opposition of said biasing means in response to the application of said predetermined force in a direction away from and substantially normal to the upper side of the ski which carries said support.

30. A binding as defined in claim 29, wherein the elements of said second group include rollers having conical portions and said surface of said carriage normally abuts against said conical portions.

* * * * *